US006878009B2

(12) United States Patent
Amemiya

(10) Patent No.: US 6,878,009 B2
(45) Date of Patent: Apr. 12, 2005

(54) ELECTRICAL CONNECTOR ASSEMBLY AND WIRE PROTECTOR

(75) Inventor: Shinji Amemiya, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/417,535

(22) Filed: Apr. 17, 2003

(65) Prior Publication Data

US 2003/0199193 A1 Oct. 23, 2003

(30) Foreign Application Priority Data

Apr. 17, 2002 (JP) ..... 2002-114652

(51) Int. Cl.[7] ..... H01R 13/58
(52) U.S. Cl. ..... 439/470; 439/467
(58) Field of Search ..... 439/467, 470

(56) References Cited

U.S. PATENT DOCUMENTS 5,391,092 A * 2/1995 Sumida ..... 439/470
5,762,520 A * 6/1998 Martin ..... 439/470
5,908,327 A * 6/1999 Tsuji et al. ..... 439/470
5,967,830 A * 10/1999 Tsuji ..... 439/470
6,019,638 A * 2/2000 Saka et al. ..... 439/620
6,203,362 B1 * 3/2001 Tsuji ..... 439/470
6,454,594 B2 * 9/2002 Sawayanagi ..... 439/467
6,478,609 B1 * 11/2002 Davis et al. ..... 439/470

FOREIGN PATENT DOCUMENTS

JP 5-13128 1/1993
JP 7-22061 5/1995

* cited by examiner

*Primary Examiner*—Gary Pauman
(74) *Attorney, Agent, or Firm*—Barley, Snyder, Senft & Cohen, LLP

(57) ABSTRACT

An electrical connector assembly and a wire protector used therefore for protecting wires led out of said electrical connector from damage. Said electrical connector has an insulative housing provided with contacts. Said contacts are connected to said wires that are led out of said electrical connector. Said wire protector has a connector mounting portion mounted on an outer wall of said electrical connector. A wire holding portion is integrally formed with said connector mounting portion. Said wire holding portion loosely holds said wires that are led out from said electrical connector at a position remote from said electrical connector while maintaining a direction thereof to reduce stress thereon.

18 Claims, 7 Drawing Sheets

ELECTRICAL CONNECTOR ASSEMBLY AND WIRE PROTECTOR

FIELD OF THE INVENTION

The invention relates to an electrical connector assembly with a wire protector and, more specifically, to a wire protector for holding wires led out from a rear portion of a housing.

DESCRIPTION OF THE RELATED ART

Wires attached to contacts within an electrical connector are led out from one end of the electrical connector after being connected thereto. The led out wires are provided as a wire harness to various electronic equipment on which the electrical connector is mounted. There is a risk that conductive cores of the wires will become damaged due to excessive forces being exerted on the portion of the wires that are led out from the connector by pulling and bending of the wires.

Various wire harness protectors have been developed to prevent the wires from becoming damaged. One example of a wire harness protector is disclosed in Japanese Utility Model Publication No. 7(1995)-22061. This wire harness protector has an elongated protector main body that contains wires therein. A pair of engagement pieces constructed to hold wire crimping portions that have been terminated onto the wires are arranged at a distal end of the main body. The wires have been connected to contacts housed within the protector main body. Contact portions, for contacting other contacts, of the contacts protrude from a distal end of the protector main body. The whole wire harness protector is inserted within a contact housing space of an electrical connector housing. The inserted contacts are engaged with a housing lance within the contact housing space and thereby are secured in the connector housing. The wire harness protector is also engaged to the connector housing via the contacts.

Another example of a wire harness protector is disclosed in Japanese Unexamined Patent Publication No. 5(1993)-13128. This wire harness protector has wire pressing members formed integrally with a housing of the connector via a hinge. The wire pressing members cooperate with the housing to press and hold wires and to lock the wires to the housing in the pressed and held state.

With regard to the wire harness protector disclosed in Japanese Utility Model Publication No. 7(1995)-22061, stress is likely to be applied to the contacts engaged within the housing, because the protector main body is long. In addition, stress is also applied to the housing lance via the contacts. As a result, excess force is exerted on the contacts, and there is a risk that the housing lance will be deformed or damaged. Further, in the case that the wires are bent at acute angles at the exit end of the protector main body, there is a risk that the wires will break.

With regard to the connector disclosed in Japanese Unexamined Patent Publication No. 5(1993)-13128, the connector as a whole is elongated because the wire pressing members are formed integrally with the housing. This connector would be used even for a case in which the wire pressing members are not necessary. In addition, the connector path becomes elongated as a matter of necessity. The contacts terminated onto the wires need to be inserted within the elongated path, thereby deteriorating the insertion operability. Further, as the wires are pressed and held individually by the wire pressing members, in the case that the core of the wires are comparatively thin, there is a risk that the core will be broken by the pressing force.

With regard to the existing technology described above, consideration is given to protection against bending of the portions of the wires which are led out from the connectors, and to stress relief for the wires with contacts terminated thereon. However, depending on the intended use of electrical connectors, there are cases in which it is necessary that the wires are distributed while maintaining predetermined positional relationships with respect to each other, instead of being distributed separately as individual wires. For example, in the case that the wires are distributed along a roof of an automobile, a so-called flat cable, in which an outer covering is molded so that the wires are arranged in a row and maintained in that state, is used. The portions of the wires that are led out are separated from the outer coverings in order to connect the wires to the contacts while maintaining positional relationships.

If the electrical connector assembly is to be placed at a rear seat of an automobile after being pulled around to pass through the roof thereof in the manner described above, a flat cable used in conjunction with the electrical connector assembly is pulled around the roof of the automobile in a similar manner. With regard to uses like this, in the case that the wires are bent within the plane of the rows in which the wires are arranged, excessive tension is applied to the wires positioned to the exterior of the bent wire. If a wire positioned toward the interior is bent at an acute angle, stress becomes concentrated, and there is a high risk of damage to the wire. Therefore, a tensile strength approximately five times that of a normal wire is required. However, in the aforementioned existing technology, these problems have not been addressed.

It is therefore desirable to provide an electrical connector assembly and a wire protector therefore wherein the wires are protected against damage by reducing stress applied to the contacts and/or to the housing. It is further desirable to provide a comparatively small optional wire protector which is capable of being removed when protection of the wires is not necessary.

SUMMARY OF THE INVENTION

The invention relates to an electrical connector assembly and a wire protector used therefore. Said electrical connector has an insulative housing provided with contacts. Said contacts are connected to said wires that are led out of said electrical connector. Said wire protector has a connector mounting portion mounted on an outer wall of said electrical connector. A wire holding portion is integrally formed with said connector mounting portion. Said wire holding portion loosely holds said wires that are led out from said electrical connector at a position remote from said electrical connector while maintaining a direction thereof to reduce stress thereon.

DESCRIPTION OF THE PREFERRED EMBODIMENTS

Figure 1:
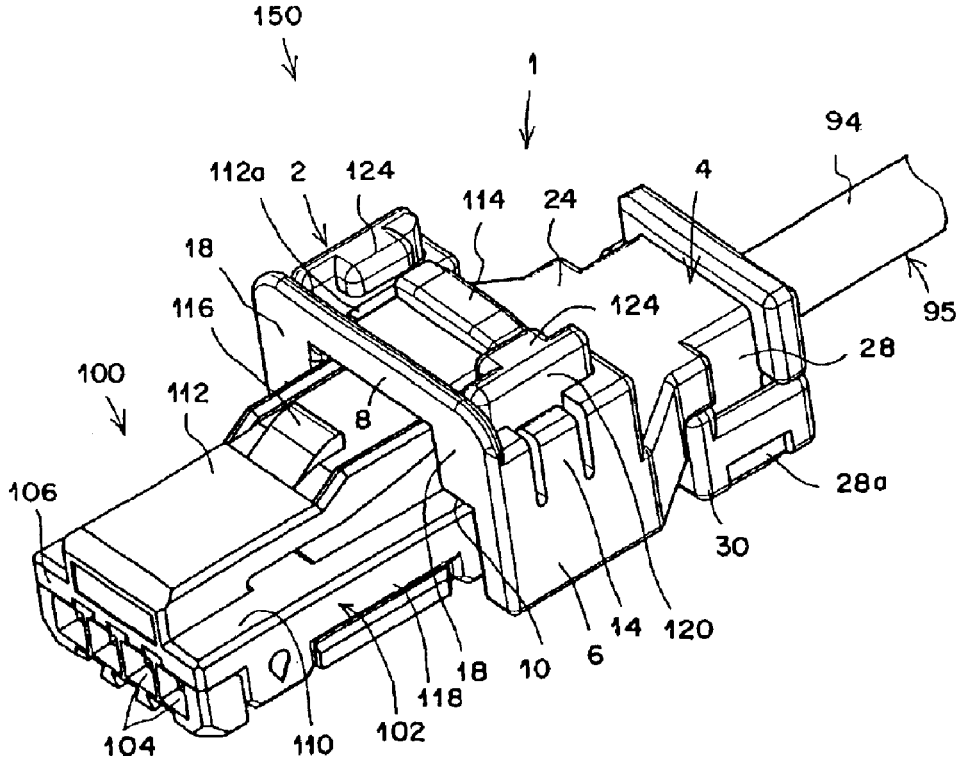
FIG. 1 is a perspective view of an electrical connector assembly in which a wire protector has been mounted on an electrical connector.
Figure 2:
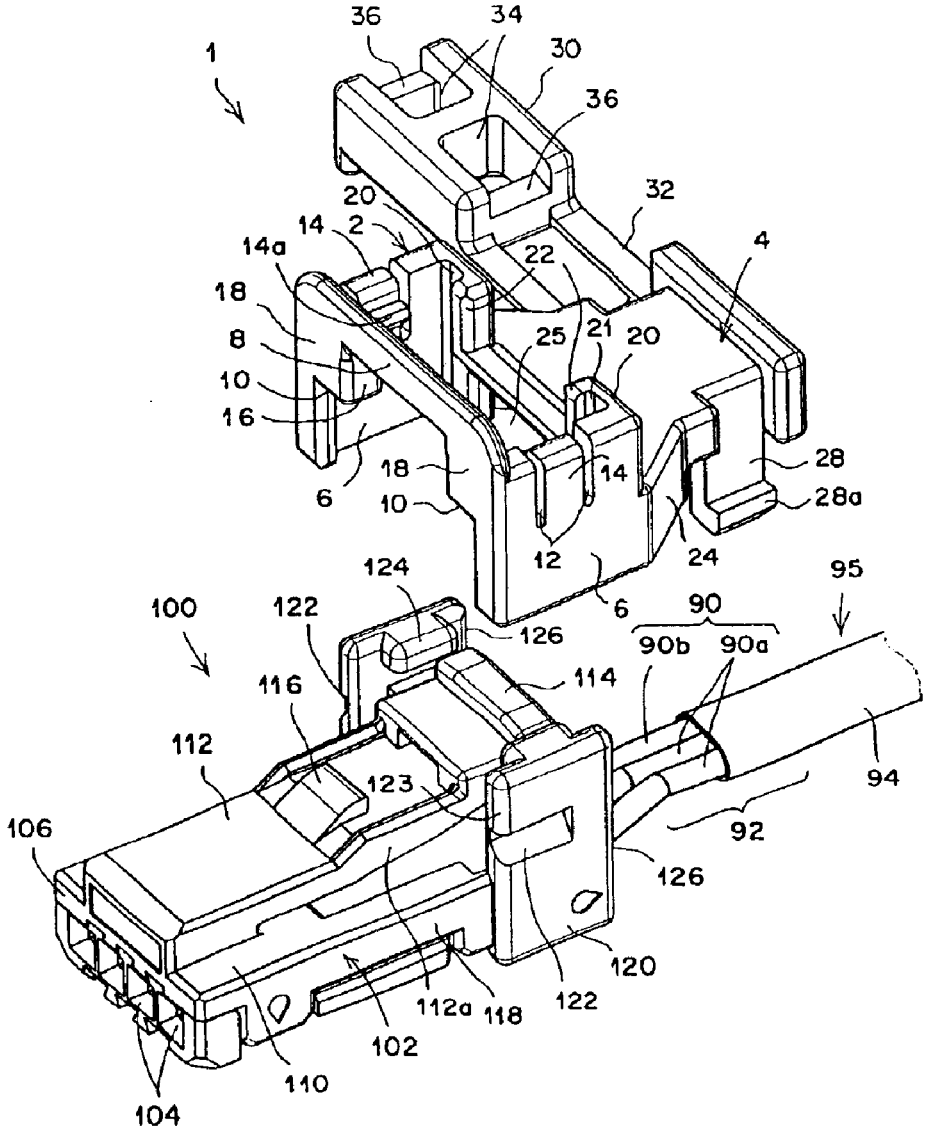
FIG. 2 is an exploded perspective view of the electrical connector assembly, in which the wire protector has been removed from the electrical connector of FIG. 1.
Figure 8:
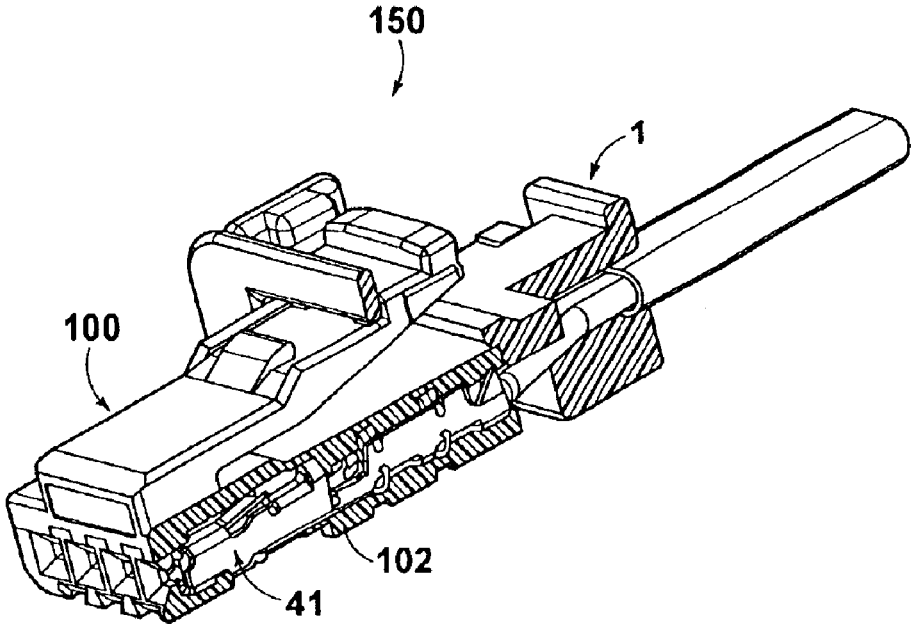
FIG. 8 is a vertical sectional view of the electrical connector assembly.

FIGS. 1 and 2 show an electrical connector assembly 150. The assembly 150 includes a connector 100 and a wire protector 1. The connector 100 has an insulative housing 102 provided with a plurality of contacts 41, best shown in FIG. 8. As shown in FIG. 2, the housing 102 is formed substantially as a rectangular prism and has a plurality of contact housing apertures 104. The contact housing apertures 104 are arranged in a row and penetrate from a front end 106 to a rear end 108 of the housing 102 along a lengthwise direction thereof. A lock arm 112 is integrally formed with the housing 102 and is provided on an upper surface 110 of the housing 102 in a vicinity of the front end 106 thereof. The lock arm 112 is formed as an elastic cantilevered beam that extends obliquely upward toward a rear end from a fixed end. A finger placement portion 114 is provided at the rear end of the lock arm 112. A protrusion 116 for engaging another connector (not shown) is formed on the lock arm 112 between the finger placement portion 114 and the fixed end thereof. (Note that here "front" refers to an engagement direction of the connector 100 with respect to another connector (not shown), and "rear" refers to a direction opposite thereto)

As shown in FIG. 2, upwardly extending planar base portions 120 (outer walls) are formed at rear ends of side walls 118 of the housing 102 so that the planar base portions 120 are positioned on both sides of the finger placement portion 114. Engagement recesses 122 (latch engagement portions) extend along a lengthwise direction of the housing 102 and are formed towards upper ends of the base portions 120. Protrusions 124 are formed on an interior side of an upper edge of each base portion 120 so as to fill a gap between the base portions 120 and lateral edges 112*a* of the lock arm 112. The protrusions 124 are provided so as to prevent damage to the lock arm 112 that may be caused by wires 90 entering the space between the base portions 120 and the lock arm 112 that may apply an excessive force thereto.

The wires 90 are connected to the contacts 41 within the connector 100. As shown in FIG. 2, the wires 90 include two thin covered wires 90*a* of American Wire Gauge (AWG) 28 and a drain wire 90*b* with an exposed conductive core. The wires 90*a*, 90*b* are arranged in a parallel row. Although in the present embodiment, the wires 90 were arranged in a single row, the wires 90 may alternatively be arranged in a plurality of rows. The covered wires 90*a* and the drain wire 90*b* are electromagnetically shielded by being covered with a copper shielding layer (not shown). An outer covering 94 covers the wires 90 in a planar manner to construct a so-called flat cable 95.

Figure 6:
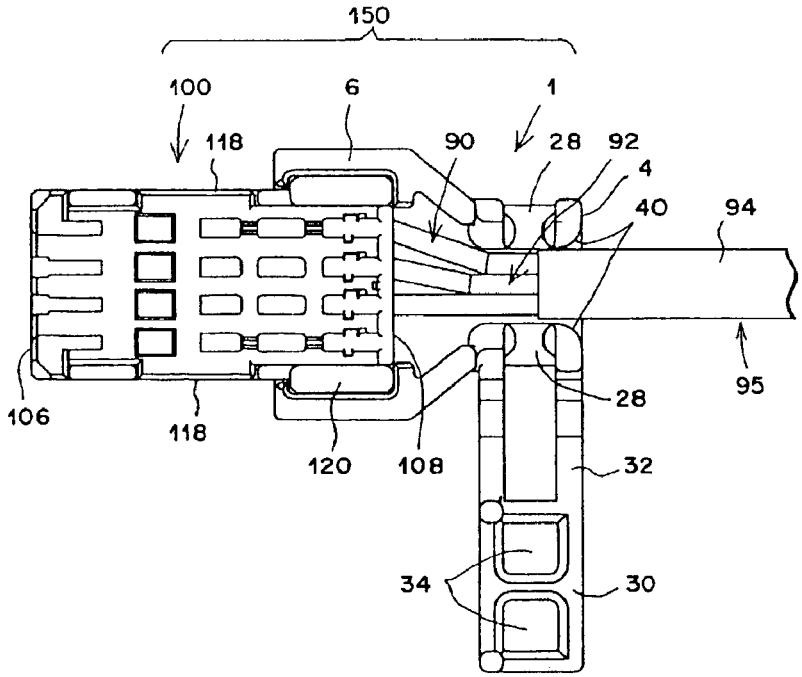
FIG. 6 is a bottom plan view of the electrical connector assembly, in which the wire protector has been mounted onto the electrical connector, and an engagement portion is not yet fixed.

The wire protector 1 mounted on the connector 100 includes a connector mounting portion 2 that is mounted on the base portions 120 of the housing 102. A wire holding portion 4 for loosely holding the wires 90 extends toward the rear of the housing 102, that is, toward portion 92 of the wires 90 which are led out from the connector 100. The holding portion 4 is positioned remote from the rear end 108 of the housing 102 and towards the portion 92 of the wires which are led out, as shown in FIG. 6.

Substantially rectangular fixing plates 6 (mounting portions) are provided on the mounting portion 2 and correspond to the base portions 120 of the connector 100. The upper front edges of the fixing plates 6 are linked by a linking plate 8. Downward facing steps 10, best shown in FIG. 4B, abut the upper surface 110 of the housing 102 when the wire protector 1 is mounted on the connector 100. The steps 10 are formed on front edges of the fixing plates 6. Tongue pieces 16, best shown in FIGS. 3B and 4B, face rearward parallel with the fixing plates 6 and are formed on a wide front wall 18 of the fixing plates 6. The tongue pieces 16 are structured so as to receive front edges 123 of the base portions 120 between the fixing plates 6. The steps 10 extend to the lower edges of the tongue pieces 16.

Figure 5A:
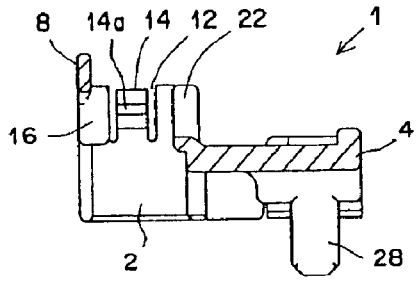
FIG. 5A is a sectional view of the wire protector taken along line 5A—5A of FIG. 3B.
Figure 5B:
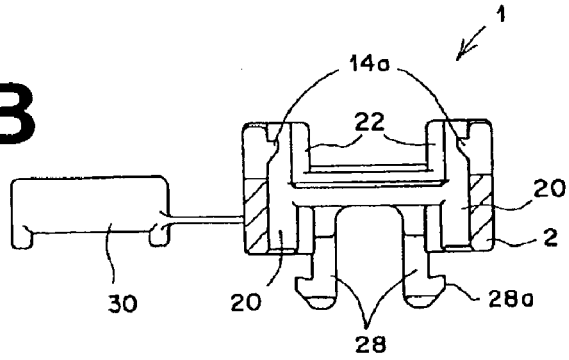
FIG. 5B is a sectional view of the wire protector taken along line 5B—5B of FIG. 3B.

As shown in FIGS. 2 and 5A, two separated downward facing slots 12 are formed on upper ends of each fixing plate 6. The slots 12 form elastically flexible latch arms 14 (latch engagement portions). Inwardly protruding protrusions 14*a*, best shown in FIGS. 5A and 5B, engage the engagement recesses 122 when the wire protector 1 is mounted on the connector 100. The protrusions 14*a* are provided in a vicinity of upper ends of the latch arms 14. Rear walls 20 extend toward each other perpendicular to the fixing plates 6 and are formed at the rear ends thereof. Forward facing tongue pieces 22, best shown in FIGS. 2 and 3B, correspond to the tongue pieces 16 and are provided on the rear walls 20. The tongue pieces 22 and the fixing plates 6 are structured to contain rear edges 126 of the base portions 120 of the connector 100 therebetween. That is, the base portions 120 of the housing 102 are structured to be received within a groove 21 formed by the tongue pieces 16, the tongue pieces 22, the fixing plates 6, and the rear walls 20.

As shown in FIG. 2, the two fixing plates 6 are integrally molded with an extension portion 24. The extension portion 24 extends so as to converge toward the rear from the rear portions of the fixing plates 6. The extension portion 24 has a C-shaped cross-section. The holding portion 4 is integrally formed at a rear end of the extension portion 24. The fixing plates 6, the linking plate 8, and the extension portion 24 form an access space 25 to allow access to the lock arm 112. The finger placement portion 114 of the lock arm 112 projects into the access space 25 such that the protruding finger placement portion 114 can be depressed by a finger to operate the lock arm 112, thereby releasing the engagement between the two connectors.

Figure 3A:
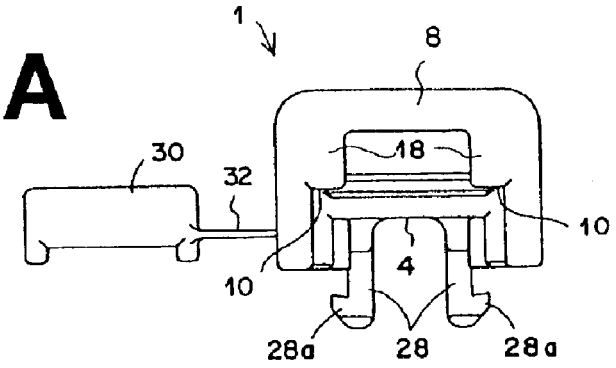
FIG. 3A is a front plan view of the wire protector.
Figure 3B:
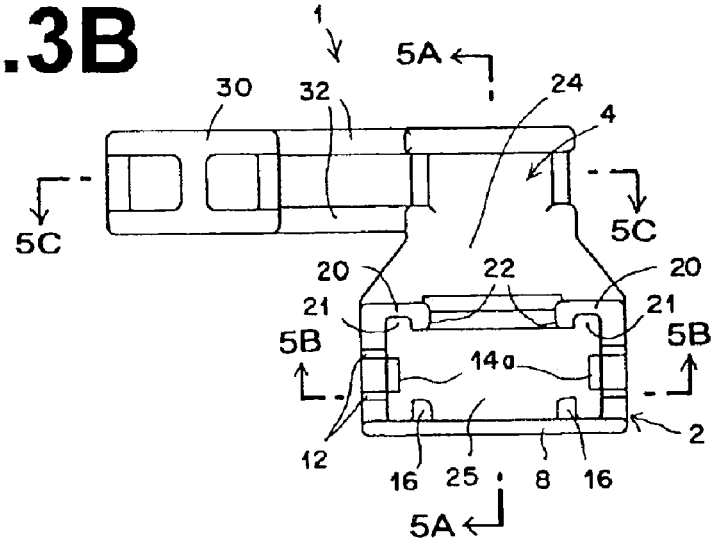
FIG. 3B is a top plan view of the wire protector.
Figure 4A:
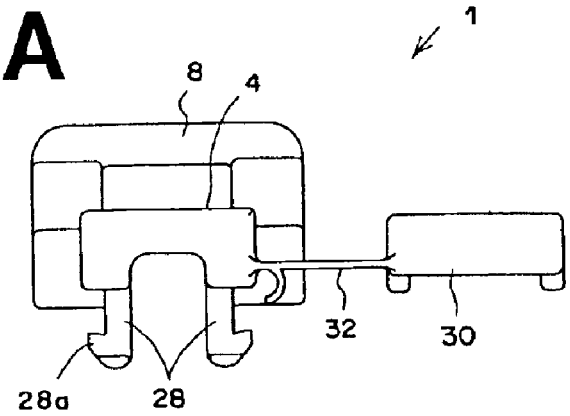
FIG. 4A is a rear plan view of the wire protector.
Figure 4B:
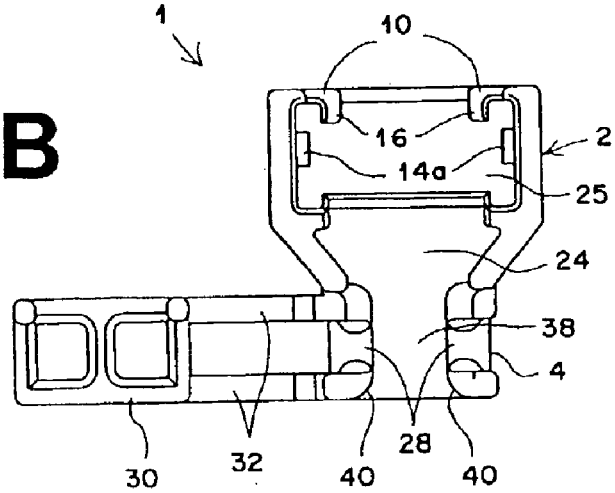
FIG. 4B is a bottom plan view of the wire protector.
Figure 5C:
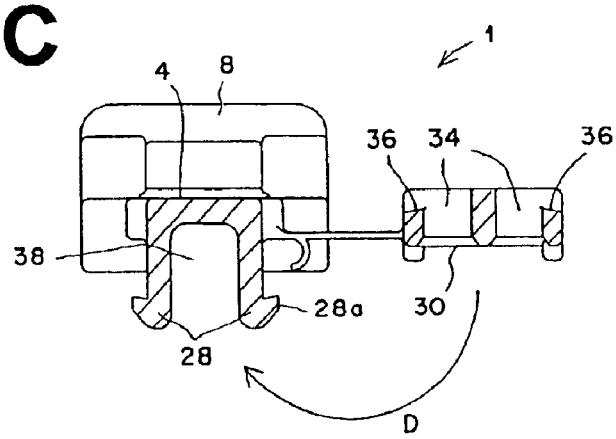
FIG. 5C is a sectional view of the wire protector taken along line 5C—5C of FIG. 3B.

Upwardly, leftwardly and rightwardly extending flanges are formed at the rear end of the holding portion 4. A pair of leg portions 28 (latch arms), best shown in FIGS. 3A and 4A, are formed to extend downward from lateral portions of the holding portion 4. An engagement portion 30, best shown in FIG. 5C, is formed integrally with the holding portion 4 in a direction perpendicular to the wires 90 to one side of the holding portion via two webs 32. Outwardly protruding protrusions 28*a* are formed at the tips of the leg portions 28. The engagement portion 30 is formed as a block having two openings 34 into which the leg portions 28 are capable of being inserted. Steps 36 for engaging with the leg portions 28 are formed in each opening 34 of the engagement portion 30 and at positions distant from each other.

Figure 7:
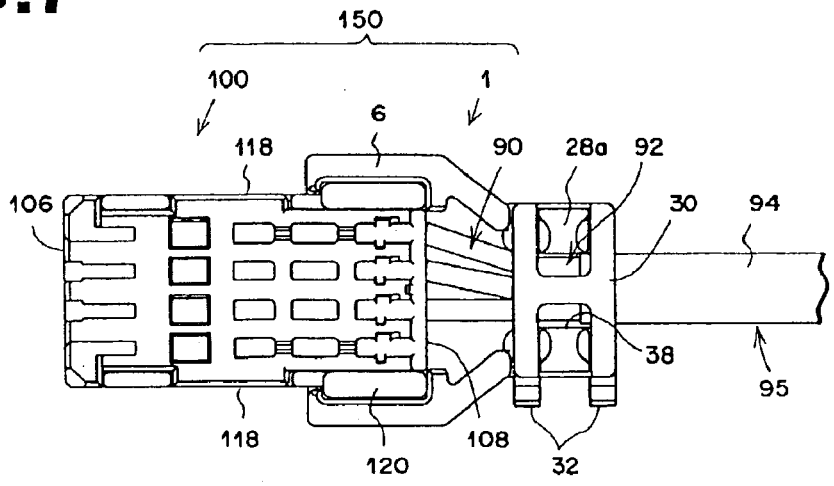
FIG. 7 is a bottom plan view of the electrical connector assembly, in which the engagement portion has been fixed.

The manner in which the wire protector 1 is mounted to the connector 100 will now be described in greater detail with reference to FIGS. 2, 6 and 7. As shown in FIGS. 2 and 6, the wire protector 1 is mounted to the connector 100 so that the base portions 120 are received within an interior of the fixing plates 6. The latch arms 14 of the wire protector 1 and the engagement recesses 122 of the base portions 120 engage to fix the wire protector 1 to the connector 100. The engagement portion 30 is rotated in a direction indicated by arrow D of FIG. 5C or toward a surface of the drawing sheet of FIG. 6 by flexing the web 32 so that the leg portions 28 enter the openings 34. When the leg portions 28 are contained within the openings 34, the protrusions 28*a* of the leg portions 28 engage with the steps 36 to fix the engagement portion 30 to the leg portions 28. A path 38 is thereby formed in the holding portion 4 for containing the wires 90. The path 38 is substantially rectangular in cross-section. As shown in FIG. 6, the wires 90 are contained between the pair of leg portions 28 so that the wires 90 are capable of slight movement in a direction perpendicular to an axial direction of the wires 90. Specifically, there is a slight gap between the wires 90 held by the holding portion 4 and the path 38 of the holding portion 4. The wires 90 are capable of slight movement in any direction perpendicular to the axial direction thereof within the gap. Because the wires 90 are loosely held within the holding portion 4, the wires 90 are also capable of moving slightly in the axial direction thereof. That is, because the linearity of the portion 92 of the wires 90 which are led out from the connector 100 is maintained over a comparatively long distance, bending stresses are distributed to the other wires 90. Therefore, damage to the wires can be effectively prevented during bending of the wires 90 because an excessive tensile force is not applied thereto. p Arcuate surfaces 40 are formed at an exit of the path 38, as shown in FIG. 6. The radius of the arcuate surfaces 40 is formed to be at least ½ the diameter of the wires 90. If the wires 90 are bent in the lateral direction, that is, within the flat plane of the flat cable 95 at the exit of the holding portion 9, the wires 90 are bent along the arcuate surfaces 90. Therefore, stress concentrated on the wires 90 is dispersed and damage to the core wires of the wires 90*a*, 90*b* or the drain wire 90*c* is prevented.

The electrical connector 100 may be easily modified according to the intended use thereof by mounting and removing the wire protector 1 as necessary. For example, the wire protector 1 may not be necessary in cases where the intended use of the connector 100 does not bend the wires or wires having high tensile strength are used. In such cases, the wire protector 1 may be removed, and the connector 100 may be used alone.

Because the portion of the wires 90 which are led out from the electrical connector 100 are loosely held at a position remote therefrom while maintaining the direction thereof, when a plurality of wires 90 outwardly extending from the wire protector 1 is bent, the wires 90 on the exterior side are bent at a position remote from the end portion of the connector 100, with some latitude with respect to extension thereof. In addition, because the wires 90 are loosely held, excessive tensile force is not generated. Further, because the wires 90 on the interior side are also bent while being held loosely, the bending stress can be dispersed by the wires moving slightly to relieve the stress, thereby preventing damage to the wires 90.

What is claimed is:

1. An electrical connector assembly, comprising:

an electrical connector having an insulative housing provided with contacts, said contacts connected to wires that are led out of said electrical connector in a single row; and a wire protector having a connector mounting portion mounted on an outer wall of said electrical connector and a wire holding portion integrally formed with said connector mounting portion, said wire holding portion having a path that loosely holds said wires that are led out from said electrical connector at a position remote from said electrical connector while maintaining a direction thereof to reduce stress thereon, arcuate surfaces being formed on an exterior surface of said wire holding portion at a position where said wires exit said path such that said wires can be bent about said arcuate surfaces.

2. The assembly of claim 1, wherein said wire protector is detachable from said electrical connector.

3. The assembly of claim 1, further comprising latch arms that fix said wire protector to said electrical connector.

4. The assembly of claim 1, wherein said outer wall of said electrical connector is received within an interior of said connector mounting portion.

5. The assembly of claim 1, wherein said connector mounting portion includes an access space to allow access to a lock arm provided on said electrical connector.

6. The assembly of claim 1, wherein said wire holding portion includes leg portions that are received in openings of an engagement portion to form said path that loosely holds said wires.

7. The assembly of claim 1, wherein said engagement portion extends from said wire holding portion via a web and said engagement portion is rotated into engagement with said leg portions by flexing said web.

8. The assembly of claim 6, wherein said path is substantially rectangular in cross-section.

9. A wire protector, for protecting a portion of wires which are led out from an electrical connector in a single row, comprising:

a connector mounting portion for mounting on an outer wall of said electrical connector; and a wire holding portion integrally formed with said connector mounting portion, said wire holding portion having a path configured for loosely holding said wires that are led out from said electrical connector at a position remote from said electrical connector while maintaining a direction thereof to reduce stress thereon, arcuate surfaces being formed on an exterior surface of said wire holding portion at a position where said wires exit said path such that said wires can be bent about said arcuate surfaces.

10. The wire protector of claim 9, further comprising latch arms for fixing said wire protector to said electrical connector.

11. The wire protector of claim 9, wherein said connector mounting portion includes an access space to allow access to a lock arm provided on said electrical connector.

12. The wire protector of claim 9, wherein said wire holding portion includes leg portions that are received in openings of an engagement portion to form said path that loosely holds said wires.

13. The wire protector of claim 12, wherein said engagement portion extends from said wire holding portion via a web and said engagement portion is rotated into engagement with said leg portions by flexing said web.

14. The wire protector of claim 12, wherein said path is substantially rectangular in cross-section.

15. The assembly of claim 1, further comprising an engagement portion rotatably attached to said wire holding portion and engageable with said wire holding portion such that said wires are positioned therebetween, said wire holding portion having two of said arcuate surfaces, said arcuate surfaces being positioned on opposite sides of said path.

16. The assembly of claim 15, wherein each of said arcuate surfaces has a radius that is at least half of a diameter of said wires.

17. The wire protector of claim 9, further comprising an engagement portion rotatably attached to said wire holding portion and engageable with said wire holding portion such that said wires are positioned therebetween, said wire holding portion having two of said arcuate surfaces, said arcuate surfaces being positioned on opposite sides of said path.

18. The wire protector of claim 17, wherein each of said arcuate surfaces has a radius that is at least half of a diameter of said wires.

* * * * *

UNITED STATES PATENT AND TRADEMARK OFFICE

CERTIFICATE OF CORRECTION

PATENT NO. : 6,878,009 B2
DATED : April 12, 2005
INVENTOR(S) : Shinji Amemiya

It is certified that error appears in the above-identified patent and that said Letters Patent is hereby corrected as shown below:

Column 6,
Line 33, "The assembly of claim 1" should read -- The assembly of claim 6 --.
Line 39, "A wire protector, for" should read -- A wire protector for --.

Signed and Sealed this

Sixth Day of September, 2005

JON W. DUDAS
*Director of the United States Patent and Trademark Office*